US006728970B1

(12) United States Patent
Grilliot et al.

(10) Patent No.: US 6,728,970 B1
(45) Date of Patent: May 4, 2004

(54) PROTECTIVE GARMENT HAVING REVERSIBLE SHELL FOR MILITARY OR PARAMILITARY FIREFIGHTER

(75) Inventors: William L. Grilliot, Dayton, OH (US); Mary I. Grilliot, Dayton, OH (US); Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/350,871

(22) Filed: Jan. 24, 2003

(51) Int. Cl.[7] ..... A41D 13/00
(52) U.S. Cl. ..... 2/81; 2/97
(58) Field of Search ..... 2/81, 93, 94, 96, 2/97, 69, 85, 915, 115, 77, 102, DIG. 2

(56) References Cited

U.S. PATENT DOCUMENTS

| | | | | | |
|---|---|---|---|---|---|
| 238,945 | A | | 3/1881 | Marks | |
| 1,052,475 | A | | 2/1913 | Friedman | |
| 1,224,704 | A | | 5/1917 | Berger | |
| 1,648,250 | A | | 11/1927 | Woislawsky | |
| 1,914,236 | A | | 6/1933 | Berkwits | |
| 1,971,682 | A | | 4/1934 | Hoch | |
| 2,138,041 | A | | 11/1938 | Preston | |
| 2,174,831 | A | | 10/1939 | Müller | |
| 2,711,539 | A | * | 6/1955 | Loscher | 2/93 |
| 3,018,486 | A | | 1/1962 | Bukspan | |
| 4,103,361 | A | | 8/1978 | Carmen | |
| 4,338,686 | A | | 7/1982 | Bell | |
| 4,472,835 | A | * | 9/1984 | Clark | 2/102 |
| 4,774,725 | A | | 10/1988 | Page | |
| 5,029,344 | A | * | 7/1991 | Shannon et al. | 2/69 |
| 5,040,243 | A | | 8/1991 | Tatsuno | |
| 5,043,202 | A | | 8/1991 | Knickerbocker | |
| 5,054,125 | A | | 10/1991 | Snedeker | |
| 5,159,718 | A | | 11/1992 | Moyer | |
| 5,189,737 | A | | 3/1993 | Ribicic | |
| 5,542,124 | A | | 8/1996 | Grilliot et al. | |
| 5,884,332 | A | | 3/1999 | Snedeker | |
| 5,933,865 | A | * | 8/1999 | Aldridge | 2/81 |
| 6,089,194 | A | | 7/2000 | LaBelle | |
| 6,345,393 | B1 | * | 2/2002 | Bayer | 2/94 |
| 6,421,834 | B2 | | 7/2002 | Kester | |
| 6,550,066 | B1 | | 4/2003 | Brassey | |

OTHER PUBLICATIONS

Cabela's Fall Sale 1998, Cabela's, p. 14.
Body–Guard Apparel, Division of Lion Apparel, Inc., 1971 Series, pp. 1–4, Sep. 1986.

* cited by examiner

*Primary Examiner*—Tejash Patel
(74) *Attorney, Agent, or Firm*—Wood, Phillips, Katz, Clark & Mortimer

(57) ABSTRACT

A protective garment for a military or paramilitary firefighter or emergency worker has an outer shell, which has two expansive surfaces comprised of a surface of high visibility and a surface of low visibility. The outer shell is reversible so that, when the protective garment is worn, one such surface becomes an outer surface of the outer shell and the other surface becomes an inner surface of the outer shell. The outer shell having portions that are reflective, fluorescent, or both on the surface of high visibility but not on the surface of low visibility. The protective garment has an inner liner, which is attachable detachably to the outer shell so as to be wearable within whichever of the expansive surfaces becomes the inner surface of the outer shell.

5 Claims, 1 Drawing Sheet

PROTECTIVE GARMENT HAVING REVERSIBLE SHELL FOR MILITARY OR PARAMILITARY FIREFIGHTER

TECHNICAL FIELD OF THE INVENTION

This invention pertains to a protective garment for a firefighter or emergency worker, particularly a military or paramilitary firefighter or emergency worker. This invention contemplates that an outer shell of the protective garment is reversible so as to expose, as an outer surface, either an expansive surface of high visibility or an expansive surface of low visibility.

BACKGROUND OF THE INVENTION

Protective garments for firefighters and emergency workers include coats, trousers, overalls, and coveralls. Currently, National Fire Protection Association (NFPA) standards require a protective garment for a firefighter to have reflective trim, which enhances the visibility of the protective garment and, therefore, the visibility of its wearer under smoke-laden and other adverse conditions. Generally, reflective trim is affixed by sewing, adhesively, or otherwise.

However, for a military or paramilitary firefighter or emergency worker operating where a tactical operation has developed or is expected to develop, a need for low visibility may override a need for high visibility. Heretofore, a military or paramilitary firefighter or emergency worker may have to be issued two types of protective garments, i.e., protective garments to be worn in a tactical operation, in which the need for low visibility overrides the need for high visibility, and protective garments to be worn otherwise.

SUMMARY OF THE INVENTION

This invention provides a protective garment for a military or paramilitary firefighter or emergency worker. The protective garment has an outer shell, which has two expansive surfaces, and an inner liner. The expansive surfaces are comprised of a surface of high visibility and a surface of low visibility.

The outer shell is reversible so that, when the protective garment is worn, one said surface becomes an outer surface of the outer shell and the other surface becomes an inner surface of the outer shell. The inner liner is attachable detachably to the outer shell so as to be wearable within whichever of the expansive surfaces becomes the inner surface of the outer shell.

The outer shell has portions that are reflective, fluorescent, or both on the surface of high visibility but not on the surface of low visibility. Those portions may be provided by reflective trim affixed by sewing, adhesively, or otherwise to the shell, on the surface of high visibility. Preferably, when facing outwardly, the surface of low visibility appears black, or at least dark, in ambient light. Alternatively, when facing outwardly, the surface of low visibility displays camouflage.

DETAILED DESCRIPTION OF THE ILLUSTRATED EMBODIMENT

Figure 1:
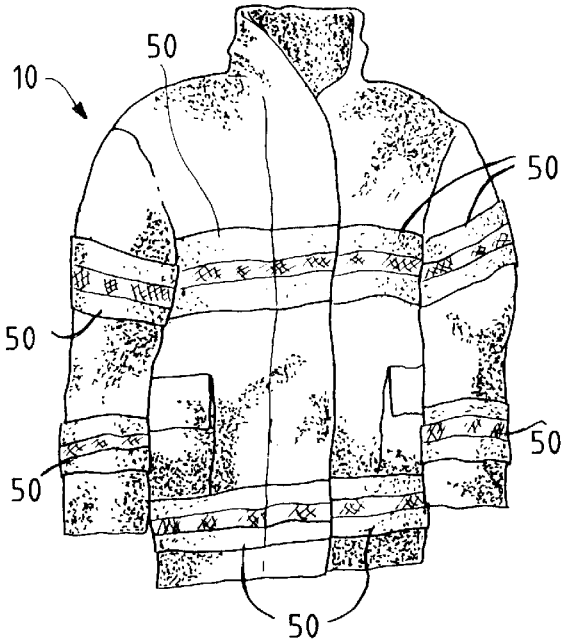
FIG. 1 is a front elevation of a protective coat embodying this invention and having an outer shell, which is reversible, as worn with an outer surface of the outer shell being of high visibility because of reflective trim.

As illustrated, a protective coat 10 for a military or paramilitary firefighter or emergency worker embodies this invention and has an outer shell 20 and an inner liner 30. The outer shell 20 has two expansive surfaces, which are comprised of a surface 40 of high visibility because of reflective trim 50 affixed by sewing, adhesively, or otherwise to the outer shell, on the surface 40, and a surface 60 of low visibility. The outer shell 20 is reversible so that, when the protective coat 10 is worn, one said surface 40, 60, becomes an outer surface of the outer shell and the other surface 40, 60, becomes an inner surface of the outer shell 20.

Figure 2:
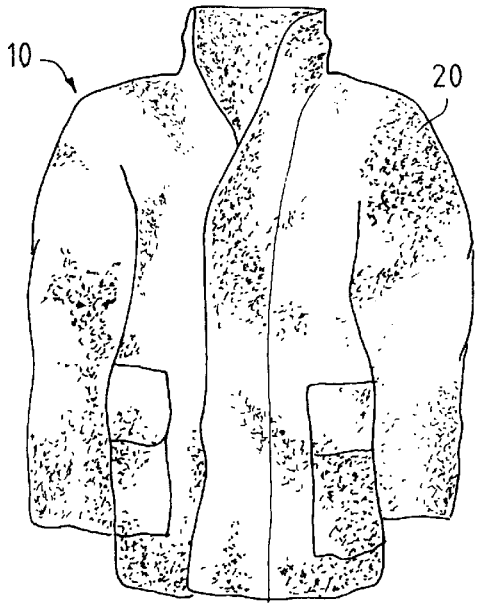
FIG. 2 is a front elevation of the same coat, as worn with the outer surface of the outer shell being of low visibility.
Figure 3:
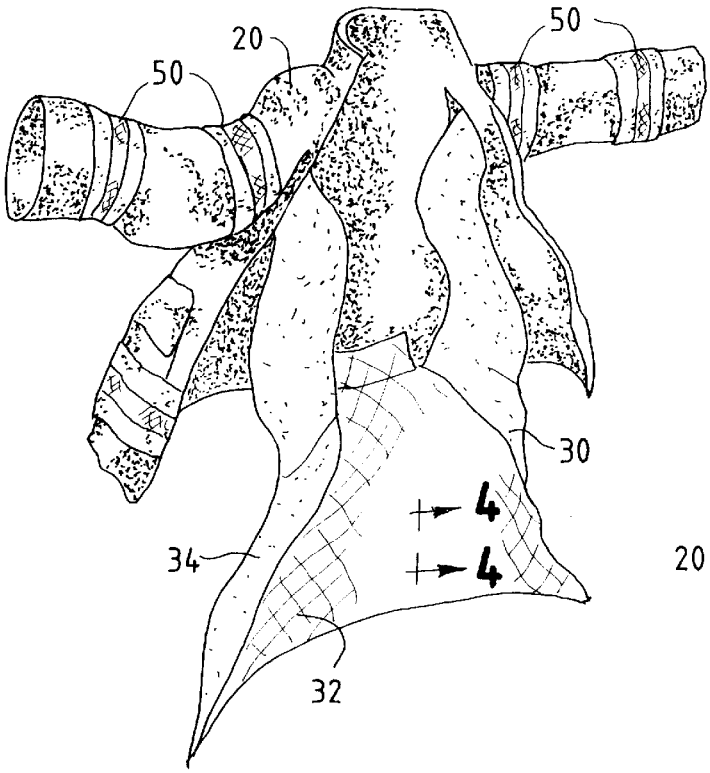
FIG. 3 is a similar view of the same coat, as illustrated in FIG. 1, except that the coat is open so as to illustrate that an inner liner of the coat is detachable.
Figure 5:
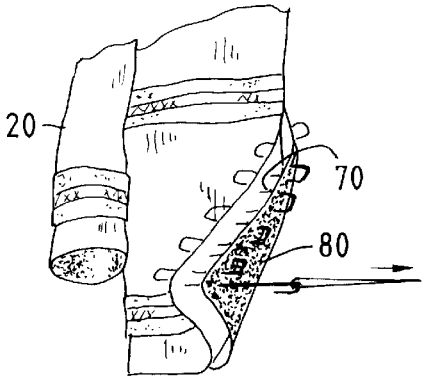
FIG. 5 is a fragmentary detail illustrating that, in an alternative embodiment, the outer shell has two layers affixed to each other, as by sewing, one said layer providing a surface of high visibility because of reflective trim and the other layer providing a surface of low visibility.

Preferably, as illustrated in FIGS. 1, 2, and 3, the outer shell 20 is made from a single layer of material, which appears black, or at least dark, in ambient light, except where reflective trim 50 is provided, or which displays camouflage, except where reflective trim 50 is provided. Alternatively, as illustrated in FIG. 5, the outer shell 20 is made from two layers of material, which are affixed to each other by sewing, as illustrated, adhesively, or otherwise and which are comprised of a layer 70 having reflective trim 50 and providing the surface 40 of high visibility and a layer 80 appearing black, or at least dark, in ambient light or displaying camouflage and, moreover, providing the surface 60 of low visibility.

Preferably, whether made from a single layer of material or from two layers of material, the outer shell 20 conforms to National Fire Protection Association (NFPA) standards for outer shells of protective garments for firefighters. A preferred material for the outer shell 20, when made from a single layer, is Nomex™ material having a basis weight of nine ounces (9 oz.) per square yard, as available commercially from E. I. du Pont de Nemours and Company of Wilmington, Del. Such material is available commercially in patterns that display camouflage. Such material having a combined basis weight of nine ounces (9 oz.) per square yard in two layers is useful for the outer shell 20, when made from two layers. Scotchlite™ reflective trim is suitable, as available commercially from Minnesota Mining and Manufacturing Company of St. Paul, Minn.

Figure 4:
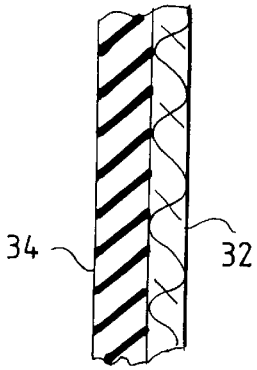
FIG. 4, on a larger scale, is a fragmentary cross-section taken along line 4—4 of FIG. 3, in a direction indicated by arrows.

As illustrated in FIG. 4, the inner liner 30 comprised a layer 32 defining a moisture barrier and a layer 34 providing thermal insulation. Additionally, the inner liner 30 may comprise another layer or other layers. The inner liner 30 is attachable detachably to the outer shell 20, via snaps, buttons, zippers, hook-and-loop fasteners, or other known means, so as to be wearable within whichever of the expansive surfaces 40, 60, becomes the inner surface of the outer shell 20. Although a protective coat is illustrated, this invention may be also embodied in other protective garments, such as trousers, overalls, and coveralls.

In a tactical operation, in which the need for low visibility overrides the need for high visibility, a military or paramilitary firefighter or emergency worker may wear the protective coat 10 with the surface 60 of low visibility facing outwardly. Otherwise, the firefighter or emergency worker may wear the protective coat 10 with the surface 40 of high visibility facing outwardly. If a tactical operation develops or is expected to develop while a military or paramilitary firefighter or emergency worker is wearing the protective garment 10 with the surface 40 of high visibility facing outwardly, the firefighter or emergency worker may have an opportunity to doff the protective coat 10, detach the inner liner 20, reverse the outer shell 20, re-attach the inner liner 20, and re-don the protective coat 10 with the surface 60 of low visibility facing outwardly.

What is claimed is:

1. A protective garment for a military or paramilitary firefighter or emergency worker, the protective garment having an outer shell, which conforms to National Fire Protection Association (NFPA) standards for outer shells of protective garments for firefighters and which has two expansive surfaces comprised of a surface of high visibility and a surface of low visibility, the outer shell being reversible so that, when the protective garment is worn, one said surface becomes an outer surface of the outer shell and the other surface becomes an inner surface of the outer shell, the outer shell having portions that are reflective, fluorescent, or both on the surface of high visibility but not on the surface of low visibility, the protective garment having an inner liner, which is attachable detachably to the outer shell so as to be wearable within whichever of the expansive surfaces becomes the inner surface of the outer shell.

2. The protective garment of claim 1 wherein those portions may be provided by reflective trim affixed to the shell, on the surface of high visibility.

3. The protective garment of claim 1 wherein, when facing outwardly, the surface of low visibility appears dark in ambient light.

4. The protective garment of claim 1 wherein, when facing outwardly, the surface of low visibility appears black in ambient light.

5. The protective garment of claim 1 wherein, when facing outwardly, the surface of low visibility displays camouflage.

* * * * *